US007287408B2

(12) United States Patent
Kawai et al.

(10) Patent No.: US 7,287,408 B2
(45) Date of Patent: Oct. 30, 2007

(54) APPARATUS AND METHOD OF PRODUCING BATTERY CASE

(75) Inventors: Masanori Kawai, Toyota (JP); Kazunori Noba, Toyota (JP); Toshi Saeki, Toyota (JP); Takahisa Morita, Higashiosaka (JP); Norikazu Morita, Higashiosaka (JP); Haruo Morita, Higashiosaka (JP)

(73) Assignee: Kojima Press Industry Co. Ltd., Toyota-Shi (JP)

( * ) Notice: Subject to any disclaimer, the term of this patent is extended or adjusted under 35 U.S.C. 154(b) by 0 days.

(21) Appl. No.: 11/438,528

(22) Filed: May 22, 2006

(65) Prior Publication Data

US 2006/0266092 A1 Nov. 30, 2006

(30) Foreign Application Priority Data

May 24, 2005 (JP) ..... 2005-150609

(51) Int. Cl.
*B21D 22/28* (2006.01)

(52) U.S. Cl. ..... 72/349; 72/379.4

(58) Field of Classification Search ..... 72/347, 72/348, 349

See application file for complete search history.

(56) References Cited

U.S. PATENT DOCUMENTS 3,636,748 A * 1/1972 Hall et al. ..... 72/349
4,183,238 A * 1/1980 Maillet ..... 72/349

FOREIGN PATENT DOCUMENTS

CA 2 370 882 A1 11/2000
WO 00/69004 A1 11/2000

* cited by examiner

*Primary Examiner*—Derris H. Banks
*Assistant Examiner*—Debra M Wolfe
(74) *Attorney, Agent, or Firm*—Burr & Brown

(57) ABSTRACT

An apparatus for producing a battery case which has a tubular shape with a closed end and which houses an electricity-generating element, the apparatus including: a die assembly including a blanking die, a drawing die, a redrawing die and an ironing die which have respective die holes having mutually different sizes and which are immovably and coaxially arranged in series in the order of the sizes of the die holes; a first punch, a second punch and a third punch which are disposed coaxially with respect to the die assembly such that the first through third punches can be inserted into the corresponding die holes of the respective dies; and a moving mechanism which permits the first through third punches to be inserted into the corresponding die holes.

8 Claims, 9 Drawing Sheets

APPARATUS AND METHOD OF PRODUCING BATTERY CASE

The present application is based on Japanese Patent Application No. 2005-150609 filed on May 24, 2005, the contents of which are incorporated herein by reference.

BACKGROUND OF THE INVENTION

1. Field of the Invention

The present invention relates in general to an apparatus and a method of producing a battery case, and more particularly to improvements in an apparatus and a method of producing a battery case having a tubular shape with a closed end, by performing plural sorts of press working including DI (drawing and ironing) processing.

2. Discussion of Related Art

As well known, most of dry batteries and secondary batteries are constituted such that various sorts of electricity-generating elements suitable for the respective batteries are accommodated inside a metal battery case (battery can) having a tubular shape such as cylindrical or prismatic with one of its opposing ends closed. In each of such batteries, the battery case, as a shell body of the battery, needs to be light in weight and have a structure which withstands increased internal pressures during its use.

In view of the above, there is a recently proposed technique of producing a battery case by utilizing DI (drawing and ironing) processing capable of forming a metal tubular body having a small wall thickness and a sufficiently high degree of pressure withstanding strength, namely, by utilizing a press working method in which drawing and ironing are successively performed, as disclosed in WO00/69004, for instance.

Described more specifically, in the proposed technique, a drawing operation is initially performed on a plate-like metal material using a blanking die and a blanking punch, whereby a metal blank with a predetermined shape is obtained. The thus obtained metal blank is then subjected to a drawing operation using a drawing die and a drawing punch, thereby forming a tubular intermediate product having a closed end and a small depth. Subsequently, the intermediate product is subjected to DI processing wherein a plurality of redrawing operations and a plurality of ironing operations are successively performed using (i) a DI punch, (ii) a first die assembly (die mechanism) including a plurality of redrawing dies whose die holes have mutually different sizes and which are arranged in the order of the sizes of the die holes, and (iii) a second die assembly (die mechanism) including a plurality of ironing dies whose die holes have mutually different sizes and which are arranged in the order of the sizes of the die holes. Consequently, there is formed an intended battery case, which has a tubular shape having a closed end and a larger depth and a smaller wall thickness than the intermediate product. According to the proposed technique, it is possible to obtain, with high reliability, a battery case that is light in weight and has a structure that withstands increased internal pressure of the battery during its use.

In the proposed technique of producing the battery case, however, the step in which the plate-like metal material is formed into the intermediate product is carried out using a press machine exclusively for successively performing the blanking and the drawing, and thereafter the step in which the intermediate product is formed into the intended battery case is carried out using another press machine exclusively for performing the DI processing. Therefore, the proposed technique suffers from the following disadvantages.

Namely, where the battery case is produced according to the aforementioned conventional technique, space is needed for installing the two press machines. Further, in addition to the two press machines, a transfer device must be installed for transferring the intermediate product formed by one of the two press machines to the other. Thus, an enormous equipment investment is required, undesirably pushing up the cost of manufacture of the battery case.

SUMMARY OF THE INVENTION

The present invention has been made in the light of the situations described above. It is therefore an object of the invention to provide an apparatus and a method for producing, under industrially advantageous conditions at a reduced cost, a battery case obtained by performing plural types of press-working operations including the DI processing.

The above-indicated object of the invention may be attained according to a principle of the invention, which provides an apparatus for producing a battery case, which has a tubular shape with a closed end and which houses an electricity-generating element. The apparatus comprises a die assembly including: (i) a blanking die having a die hole with a predetermined size; (ii) a drawing die having a die hole whose size is smaller than that of the die hole of the blanking die; (iii) a redrawing die having a die hole whose size is smaller than that of the die hole of the drawing die, and (iv) an ironing die having a die hole whose size is smaller than that of the die hole of the redrawing die. The blanking die, the drawing die, the redrawing die and the ironing die are coaxially arranged in series in the order of the sizes of the die holes of the respective dies, such that the respective dies are inhibited from moving. A first punch is disposed coaxially with respect to the die assembly so as to be located on one side of the blanking die remote from the drawing die, such that the first punch can be inserted into the die hole of the blanking die and has a first accommodation hole that extends so as to be coaxial with the die hole of the blanking die. A second punch is accommodated coaxially in the first accommodation hole of the first punch such that the second punch can be advanced toward the blanking die. The blanking die is disposed so as to be insertable into the die hole of the drawing die as a result of the advancing movement thereof from the first accommodation hole, and the blanking die has a second accommodation hole that extends so as to be coaxial with the first accommodation holes. A third punch is accommodated coaxially in the second accommodation hole of the second punch such that the third punch can be advanced toward the blanking die and is disposed so as to be insertable sequentially into the die hole of the redrawing die and the die hole of the ironing die as a result of the advancing movement thereof from the second accommodation hole. A moving mechanism permits the inserting movement of the first punch into the die hole of the blanking die. The advancing movement of the second punch from the first accommodation hole and the advancing movement of the third punch from the second accommodation hole are to be performed independently of each other. With a plate-like metal material positioned between the blanking die and the first punch, the inserting movement of the first punch, the advancing movement of the second punch and the advancing movement of the third punch are carried out sequentially in order by the moving mechanism to sequentially perform: (i) a blanking operation by the first punch and the blanking die on the plate-like metal material so as to form a metal blank having a configuration that corresponds to the die hole of the blanking die; (ii) a drawing operation by the second punch and the drawing die on the metal blank so as to form a tubular intermediate product having a closed end and a predetermined depth; and (iii) a redrawing operation by the third punch and the redrawing die and an ironing operation by the third punch and the ironing die on the tubular intermediate product so as to form a tubular battery case as an end product having a closed end and a smaller wall thickness and a larger depth than the tubular intermediate product.

The present apparatus for producing a battery case constructed as described above includes the first punch for performing the blanking operation, the second punch for performing the drawing operation, and a third punch for successively or sequentially performing the redrawing operation and the ironing operation. Those three punches are assembled together such that the second punch is accommodated in the first accommodation hole formed in the first punch so as to be able to advance from the first accommodation hole and such that the third punch is accommodated in the second accommodation hole formed in the second punch so as to be able to advance from the second accommodation hole. The apparatus further has the die assembly including the blanking die, the drawing die, the redrawing die and the ironing die, those dies being assembled together. With the plate-like metal material positioned between the blanking die and the first punch, the moving mechanism initially permits the first punch to be inserted into the die hole of the blanking die, then permits the second punch to be inserted into the die hole of the drawing die as a result of the advancing movement thereof from the first accommodation hole, finally permits the third punch to be inserted sequentially into the die hole of the redrawing die and the die hole of the ironing die as a result of the advancing movement thereof from the second accommodation hole, whereby formation of the intermediate product from the plate-like metal material and formation of the battery case from the intermediate product are realized at one time in a series of steps. Therefore, a single piece of the present apparatus enables the intended battery case to be produced from the plate-like metal material with high reliability.

In the above-indicated apparatus according to the present invention, the die assembly includes the blanking die, the drawing die, the redrawing die and the ironing die, which dies are arranged in series in order so as to be inhibited from moving. Accordingly, in the series of steps in which the plate-like metal material is formed into the intermediate product and the intermediate product is formed into the battery case, the intermediate product is moved toward the redrawing die in accordance with the advancing movement of the second punch into the die hole of the drawing die, so that the intermediate product is positioned between the redrawing die and the third punch. Accordingly, the present apparatus permits speedy and reliable implementation of the DI processing in which the redrawing operation and the ironing operation are sequentially performed on the intermediate product, without a need of transferring the intermediate product by a separately provided transfer device as required in the conventional apparatus.

Therefore, unlike the conventional battery case producing apparatus using the two press machines, the battery case producing apparatus according to the present invention requires space for installing only single press machine. Further, the equipment for inserting the punches into the corresponding die holes of the dies is provided for only the single press machine. In addition, the conventionally required transfer device for transferring the intermediate product is eliminated.

In the battery case producing apparatus constructed according to the present invention, therefore, the battery case obtained by implementation of plural types of press working operations including the DI processing can be produced at reduced cost under industrially advantageous conditions. Consequently, the present apparatus attains high productivity and cost reduction of the battery case which is light in weight and has excellent pressure withstanding strength.

The present invention is preferably practiced at least in the following features.

(1) An apparatus for producing a battery case which has a tubular shape with a closed end and which houses an electricity-generating element comprises a die assembly including: (i) a blanking die having a die hole with a predetermined size; (ii) a drawing die having a die hole whose size is smaller than that of the die hole of the blanking die; (iii) a redrawing die having a die hole whose size is smaller than that of the die hole of the drawing die; and (iv) an ironing die having a die hole whose size is smaller than that of the die hole of the redrawing die, the blanking die. The drawing die, the redrawing die and the ironing die are coaxially arranged in series in the order of the sizes of the die holes of the respective dies, such that the respective dies are inhibited from moving. A first punch is disposed coaxially with respect to the die assembly so as to be located on one side of the blanking die remote from the drawing die, such that the first punch can be inserted into the die hole of the blanking die and the first punch has a first accommodation hole that extends so as to be coaxial with the die hole of the blanking die. A second punch is accommodated coaxially in the first accommodation hole of the first punch such that the second punch can be advanced toward the blanking die, is disposed so as to be insertable into the die hole of the drawing die as a result of the advancing movement thereof from the first accommodation hole, and has a second accommodation hole that extends so as to be coaxial with the first accommodation hole. A third punch is accommodated coaxially in the second accommodation hole of the second punch such that the third punch can be advanced toward the blanking die and is disposed so as to be insertable sequentially into the die hole of the redrawing die and the die hole of the ironing die as a result of the advancing movement thereof from the second accommodation hole. A moving mechanism permits the inserting movement of the first punch into the die hole of the blanking die, the advancing movement of the second punch from the first accommodation hole and the advancing movement of the third punch from the second accommodation hole to be performed independently of each other. With a plate-like metal material positioned between the blanking die and the first punch, the inserting movement of the first punch, the advancing movement of the second punch and the advancing movement of the third punch are carried out sequentially in order by the moving mechanism to sequentially perform: (i) a blanking operation by the first punch and the blanking die on the plate-like metal material so as to form a metal blank having a configuration that corresponds to the die hole of the blanking die; (ii) a drawing operation by the second punch and the drawing die on the metal blank so as to form a tubular intermediate product having a closed end and a predetermined depth; and (iii) a redrawing operation by the third punch and the redrawing die and an ironing operation by the third punch and the ironing die on the tubular intermediate product so as to form a tubular battery case as an end product having a closed end and a smaller wall thickness and a larger depth than the tubular intermediate product.

(2) The apparatus advantageously includes a first controller which controls the moving mechanism such that the inserting movement of the first punch. The advancing movement of the second punch and the advancing movement of the third punch are performed automatically and sequentially in order.

According to the above-indicated form (2), the series of steps of forming the intermediate product from the plate-like metal material and forming the battery case from the intermediate product are automated, thereby effectively enhancing the productivity of the battery case.

(3) The apparatus advantageously includes a second controller which controls the movements of the first punch, the second punch and the third punch such that the third punch is moved together with the second punch so that a leading end face of the third punch as seen in a direction of the advancing movement thereof is flush with a leading end face of the second punch as seen in a direction of the advancing movement thereof, until the tubular intermediate product is formed by the drawing operation performed by the second punch and the drawing die as a result of the advancing movement of the second punch from the first accommodation hole.

According to the above-indicated form (3), the third punch is prevented from being advanced from the second accommodation hole and therefore a portion of the metal blank is prevented from being deformed by the third punch, prior to formation of the intermediate product, in other words, prior to implementation of the drawing operation on the metal blank by the second punch and the drawing die. Therefore, the drawing operation on the metal blank can be implemented smoothly and stably. As a result, the intended battery case with a desired shape can be produced with high stability.

(4) In the apparatus according to the above form (1), the first punch is divided into a front section and a rear section as seen in a direction of the inserting movement thereof into the die hole of the blanking die, the front section and the rear section being assembled together so as to approach and separate relative to each other. The first punch is provided with a biasing device disposed between the front section and the rear section for applying biasing force to the front section and the rear section in a direction in which the front section and the rear section are separated away from each other. The metal blank is formed as a result of the inserting movement of the first punch into the die hole of the blanking die being gripped and held by and between the first punch and the drawing die based on the biasing force of the biasing device.

According to the above-indicated form (4), the front section of the first punch effectively functions as a blank holder for holding the metal blank when the drawing operation is performed on the metal blank by the second punch and the drawing die. Hence, the intermediate product formed by the drawing operation on the metal blank and accordingly the battery case to be obtained as the end product can be advantageously produced with stabilized quality without suffering from any faults or defects such as folds and wrinkles.

(5) A method of producing a battery case which has a tubular shape with a closed end and which houses an electricity-generating element, comprises a preparing step. The step includes preparing: (a) a die assembly including a blanking die having a die hole with a predetermined size, a drawing die having a die hole whose size is smaller than that of the die hole of the blanking die, a redrawing die having a die hole whose size is smaller than that of the die hole of the drawing die and an ironing die having a die hole whose size is smaller than that of the die hole of the redrawing die. The blanking die, the drawing die, the redrawing die and the ironing die being coaxially arranged in series in the order of the sizes of the die holes of the respective dies, such that the respective dies are inhibited from moving. The step further includes preparing (b) a first punch, which is disposed coaxially with respect to the die assembly so as to be located on one side of the blanking die remote from the drawing die, such that the first punch can be inserted into the die hole of the blanking die and which has a first accommodation hole that extends so as to be coaxial with the die hole of the blanking die. The step further includes preparing (c) a second punch which is accommodated coaxially in the first accommodation hole of the first punch such that the second punch can be advanced toward the blanking die, which is disposed so as to be insertable into the die hole of the drawing die as a result of the advancing movement thereof from the first accommodation hole, and which has a second accommodation hole that extends so as to be coaxial with the first accommodation hole. The step further includes preparing (d) a third punch which is accommodated coaxially in the second accommodation hole of the second punch such that the third punch can be advanced toward the blanking die and which is disposed so as to be insertable sequentially into the die hole of the redrawing die and the die hole of the ironing die as a result of the advancing movement thereof from the second accommodation hole. The method further includes a first process step in which a blanking operation by the first punch and the blanking die is performed on a plate-like metal material by inserting the first punch into the die hole of the blanking die with the plate-like metal material positioned between the blanking die and the first punch, thereby forming a metal blank having a configuration that corresponds to the die hole of the blanking die and in which the metal blank is moved toward the drawing die so as to be positioned between the second punch and the drawing die. The method further includes a second process step in which a drawing operation by the second punch and the drawing die is performed on the metal blank obtained in the first process step and positioned between the second punch and the drawing die, by advancing the second punch from the first accommodation hole so as to be inserted into the die hole of the drawing die, thereby forming a tubular intermediate product having a closed end and a predetermined depth and in which the tubular intermediate product is moved toward the redrawing die so as to be positioned between the third punch and the redrawing die. The method further includes a third process step in which a redrawing operation by the third punch and the redrawing die and an ironing operation by the third punch and the ironing die are sequentially performed on the tubular intermediate product obtained in the second process step and positioned between the third punch and the redrawing die, by advancing the third punch from the second accommodation hole so as to be inserted sequentially into the die hole of the redrawing die and the die hole of the ironing die, thereby forming a tubular battery case as an end product having a closed end and a smaller wall thickness and a larger depth than the tubular intermediate product.

In the battery case producing method according to the above-indicated form (5), the first process step of forming the metal blank from the plate-like metal material, the second process step of forming the intermediate product from the metal blank and the third process step of forming the intended battery case from the intermediate product are sequentially or consecutively carried out by using: (i) the first through the third punches which are assembled together such that the first through the third punches are coaxially arranged so as to be movable relative to each other; and (ii) the die assembly including the blanking die, the drawing die, the redrawing die and the ironing die, which dies are immovably arranged in series in order. Further, the metal blank formed by the blanking operation in the first process step is moved, in accordance with the movement of the first punch that performs the blanking operation, to a location where the drawing operation can be implemented in the second process step. Moreover, the intermediate product formed by the drawing operation in the second process step is moved, in accordance with the movement of the second punch that performs the drawing operation, to a location where the DI processing can be implemented in the third process step.

In the conventional method mentioned above, the step of forming the intermediate product from the plate-like metal material and the step of forming the battery case from the intermediate product by the DI processing are carried out using the two press machines and the transfer device for transferring the intermediate product between the two press machines, thereby producing the battery case. In contrast, in the present method according to the above-indicated form (5), the battery case can be produced at a time in the series of steps including the DI processing by using the single press machine equipped with the die assembly and the integrally assembled first through third punches. Thus, as compared with the conventional method, the present method can reduce the cost, the installation space and the like required for the equipment for producing the battery case more effectively.

Therefore, the present method according to the above-indicated form (5) permits advantageous production of the battery case that is light in weight and has a high degree of pressure withstanding strength, with excellent productivity and high economy.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE INVENTION

There will be explained in detail an apparatus and a method for producing a battery case according to the present invention by reference to the drawings.

Figure 1:
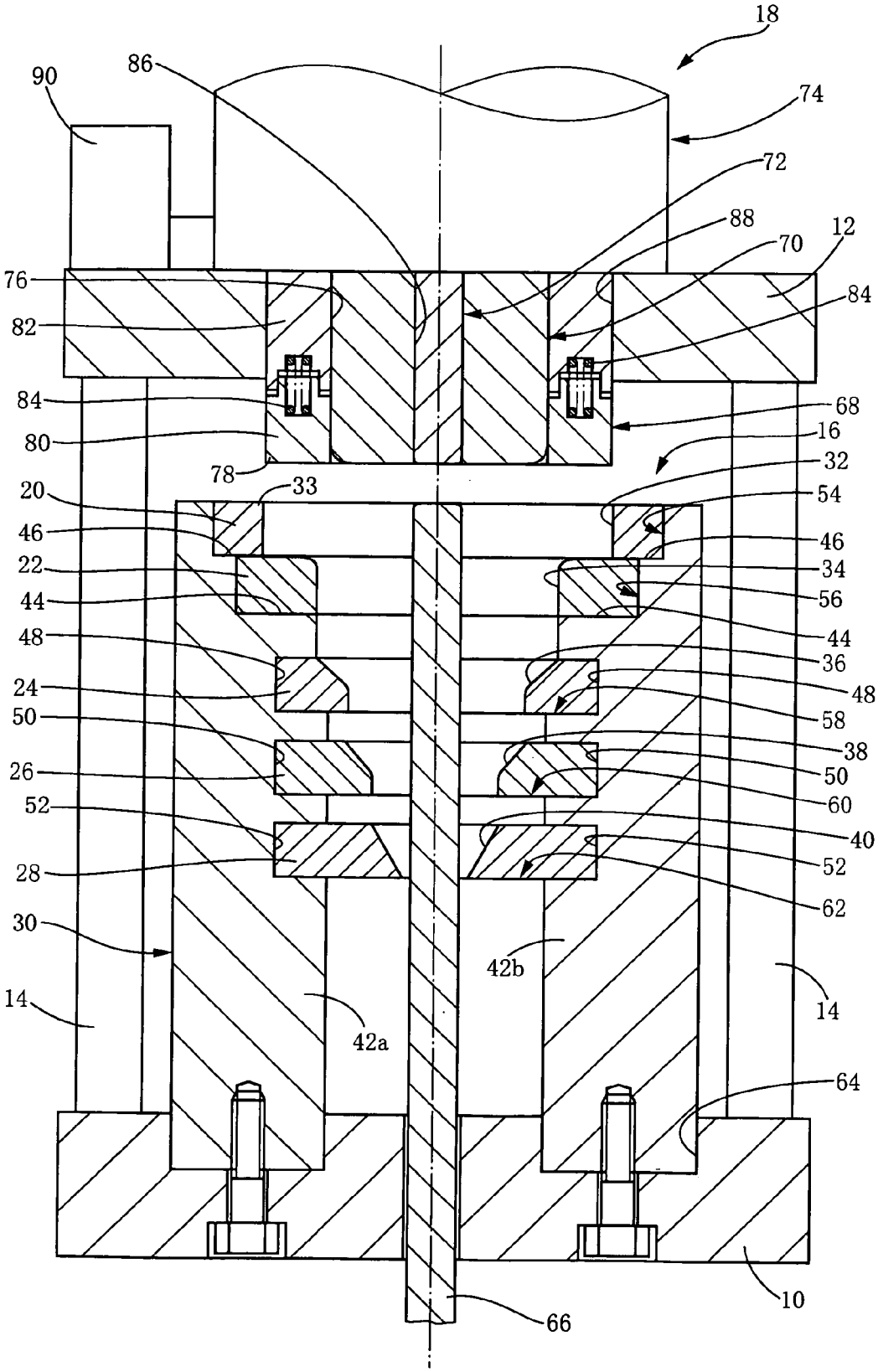
FIG. 1 is a view in vertical cross section showing one example of an apparatus for producing a battery case according to the present invention.

Referring first to FIG. 1, there is schematically shown in vertical cross section an apparatus for producing a battery case for a secondary battery, constructed according to one embodiment of the present invention. The battery case to be produced has a cylindrical shape in which one of opposite ends is closed. In FIG. 1, the reference numeral 10 denotes a lower base which is a plate or block having a large thickness. There is disposed, above the lower base 10, an upper base 12 which is a rectangular thick plate, such that the upper base 12 is opposed to the lower base 10 with a predetermined distance interposed therebetween. The upper base 12 is immovably supported by four long support posts 14 that extend upright from respective four corners of the lower base 10. A die assembly 16 is fixed to the lower base 10 while a punch mechanism 18 is supported by the upper base 12, thereby constituting the battery case producing apparatus according to the present invention.

Described more specifically, the die assembly 16 includes: five dies, i.e., a blanking die 20, a drawing die 22, a first redrawing die 24, a second redrawing die 26 and an ironing die 28; and a die holder 30 for holding those five dies 20-28.

Each of the five dies 20, 22, 24, 26, 28 has a ring-like shape as a whole. The dies 20, 22, 24, 26, 28 have respective die holes 32, 34, 36, 38, 40 having mutually different sizes and formed through central portions of the respective dies 20, 22, 24, 26, 28. Namely, the blanking die 20 has the largest ring-like shape among those five dies 20, 22, 24, 26, 28 and a die hole 32 defined by an inner circumferential surface thereof which is made as a cylindrical surface with a large diameter. In the blanking die 20, an upper edge portion of the inner circumferential surface that defines the die hole 32 is formed as an outer blade 33. The drawing die 22 has a ring-like shape smaller than the blanking die 20 and a die hole 34 defined by an inner circumferential surface thereof which is made as a cylindrical surface with a smaller diameter than the die hole 32.

The first and second redrawing dies 24, 26 and the ironing die 28 have ring-like shapes which are identical in size with each other and which are smaller than the drawing die 22.

The first and second redrawing dies 24, 26 have respective die holes 36, 38 defined by respective inner circumferential surfaces thereof each constituted by an upper tapered portion whose diameter gradually decreases in a downward direction as viewed in FIG. 1 and a lower cylindrical portion whose diameter is smaller than that of the die hole 34 of the drawing die 22. Further, the smallest inside diameter of the die hole 38 of the second redrawing die 26 is made smaller than the smallest inside diameter of the die hole 36 of the first redrawing die 24. The ironing die 28 has a die hole 40 defined by an inner circumferential surface thereof which is tapered in the downward direction with the diameter gradually decreasing in the downward direction. The smallest inside diameter of the die hole 40 of the ironing die 28 is made smaller than the smallest inside diameter of the die hole 38 of the second redrawing die 26.

In the present embodiment, therefore, the sizes of the die hole 32 of the blanking die 20, the die hole 34 of the drawing die 22, the die holes 36, 38 of the first and second redrawing dies 24, 26 and the die hole 40 of the ironing die 28 gradually decrease in this order.

The die holder 30 includes two thick-walled half-split members 42*a*, 42*b* each having a half-cylindrical shape. At an upper end portion of each of the half-split members 42*a*, 42*b*, there are formed: a lower shoulder surface 44 constituted by a half-annular surface with a small diameter and a large width; and an upper shoulder surface 46 constituted by a half-annular surface with a large diameter and a small width. Accordingly, the inner circumferential surface of each half-split member 42*a*, 42*b* is stepped at the upper end portion such that the diameter increases in two steps in the upward direction. At an axially middle portion of the inner circumferential surface of each half-split member 42*a*, 42*b*, there are formed three concave grooves 48, 50, 52 each having a rectangular cross section and extending continuously in the circumferential direction of each half-sprit member 42*a*, 42*b*. The three concave grooves 48, 50, 52 have the same depth and are spaced apart from each other by a predetermined spacing distance as viewed in the vertical direction of FIG. 1. The two half-split members 42*a*, 42*b* are assembled so as to be butted together at respective cut or split surfaces thereof, thereby forming the die holder 30 having a thick-walled cylindrical shape as a whole.

At an upper open end portion of the thus formed cylindrical die holder 30, there are provided an upper recess groove 54 and a lower recess 56. The upper recess 54 is formed such that the upper shoulder surfaces 46, 46 of the respective two half-split members 42*a*, 42*b* are connected to each other and has a large diameter and an annular bottom surface. The lower recess 56 is formed such that the lower shoulder surfaces 44, 44 of the respective two half-split members 42*a*, 42*b* are connected to each other and has a small diameter and an annular bottom surface. The lower recess 56 is located right below the upper recess 54. Further, the die holder 30 has, at an axially middle portion of the inner circumferential surface thereof, three circumferential grooves 58, 60, 62 which are respectively formed such that the three concave grooves 48, 50, 52 of the half-split member 42*a* are respectively connected to the corresponding three concave grooves 48, 50, 52 of the half-split member 42*b*. The three circumferential grooves 58, 60, 62 are spaced apart from each other by a suitable distance in the vertical direction of FIG. 1.

Within the lower circumferential groove 62 which is located at the lowest position among the three circumferential grooves 58, 60, 62, the ironing die 28 is accommodated with its outer peripheral portion held in contact, throughout the circumference thereof, with the side surfaces and the bottom surface of the lower circumferential groove 62. Within the upper circumferential groove 58 which is located at the highest position among the three circumferential grooves 58, 60, 62, the first redrawing die 24 is accommodated with its outer peripheral portion held in contact, throughout the circumference thereof, with the side surfaces and the bottom surface of the upper circumferential groove 58. Within the intermediate circumferential groove 60 which is located between the upper and lower grooves 58, 62, the second redrawing die 26 is accommodated with its outer peripheral portion held in contact, throughout the circumference thereof, with the side surfaces and the bottom surface of the intermediate circumferential groove 60.

Within the lower recess 56 of the die holder 30, the drawing die 22 is accommodated with its outer circumferential surface and lower surface respectively held in contact, throughout the circumference thereof, with the inner circumferential surfaces and the lower shoulder surfaces 44, 44 of the respective half-split members 42*a*, 42*b*. Within the upper recess 54, the blanking die 20 is accommodated such that the outer circumferential surface of the blanking die 20 is held in contact, throughout the circumference thereof, with the inner circumferential surfaces of the half-split members 42*a*, 42*b* and such that a radially outer portion of the lower surface of the blanking die 20 is held in contact with the upper shoulder surfaces 46, 46 of the respective half-split members 42*a*, 42*b* while a radially inner portion of the lower surface thereof is held in contact with a radially outer portion of the upper surface of the drawing die 22 accommodated in the lower recess 56.

Thus, the blanking die 20, the drawing die 22, the first redrawing die 24, the second redrawing die 26 and the ironing die 28 are fixedly held by the die holder 30 such that the die holes 32-40 of the respective dies 20-28 are coaxially positioned in the inner hole of the die holder 30.

Accordingly, in the present embodiment, the die assembly 16 is constituted as a unitary member in which the dies 20, 22, 24, 26, 28 are fixedly mounted on the die holder 30 such that the blanking die 20, the drawing die 22, the first redrawing die 24, the second redrawing die 26 and the ironing die 28 are coaxially arranged in series in the order of the sizes of the die holes 32, 34, 36, 38, 40 of the respective dies 20, 22, 24, 26, 28, i.e., in the order such that the sizes of the die holes 32, 34, 36, 38, 40 become smaller in the downward direction as seen in FIG. 1 while the dies 20, 22, 24, 26, 28 are positioned horizontally. The thus constructed die assembly 16 is fitted, at the lower end portion of the die holder 30 thereof, in a circular fitting groove 64 provided at a central portion of the upper surface of the lower base 10 and fixed by bolts to the same 10. Thus, the die assembly 16 is fixed to the lower base 10 so as to coaxially extend upright from the same 10. A knockout 66 arranged to be movable in the vertical direction by a knockout device not shown is disposed such that the knockout 66 penetrates the central portion of the lower base 10 and coaxially extends into the inner hole of the die holder 30 of the die assembly 16.

In the meantime, the punch mechanism 18 includes a blanking punch 68 as a first punch, a drawing punch 70 as a second punch, a DI punch 72 as a third punch, and a moving mechanism 74 for vertically moving the three punches 68, 70, 72.

Figure 3:
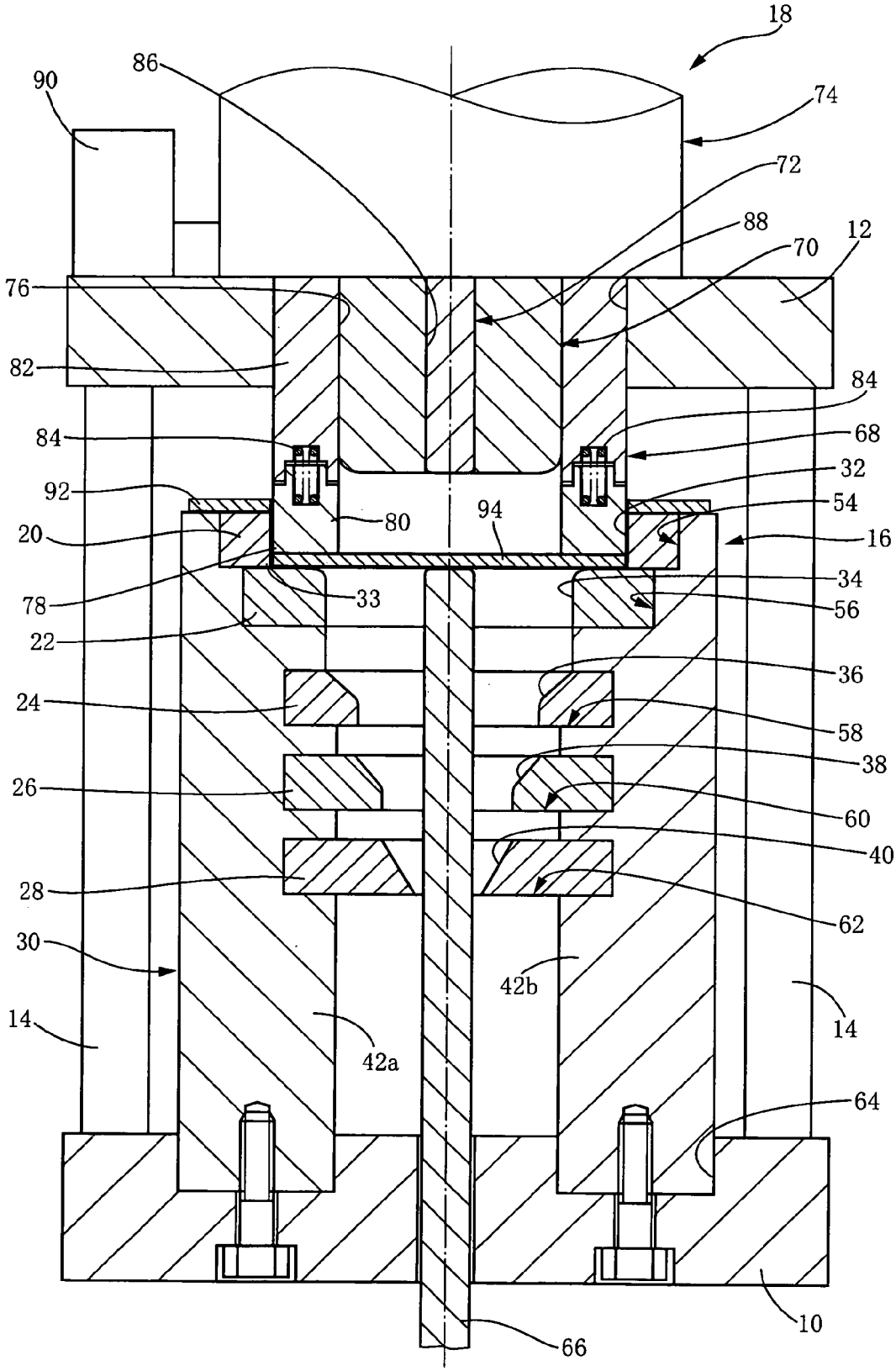
FIG. 3 is a view for explaining one example of a step following the step shown in FIG. 2, the view showing a state in which a metal blank is formed by a blanking operation performed on the plate-like metal material.

The blanking punch 68 generally has a cylindrical shape with a large thickness and a large diameter. The blanking punch 68 has an outside diameter that is determined such that the blanking punch 68 can be inserted into the die hole 32 of the blanking die 20 as shown in FIG. 3. The blanking punch 68 as the first punch has an inner hole functioning as a first accommodation hole 76. A lower edge portion of the outer circumferential surface of the blanking punch 68 is made as an inner blade 78.

Figure 4:
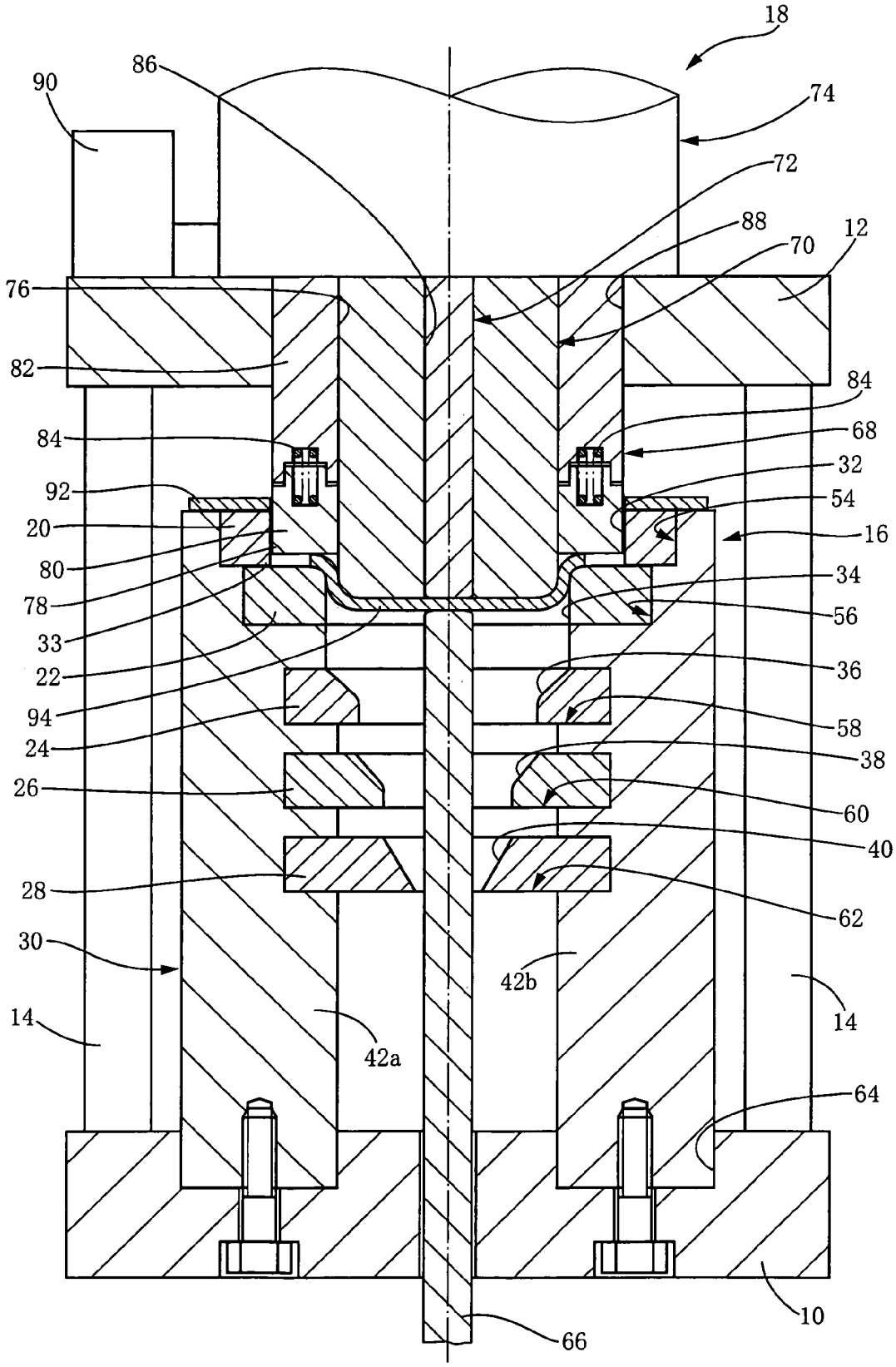
FIG. 4 is a view for explaining one example of a step following the step shown in FIG. 3, the view showing a state in which the metal blank undergoes a drawing operation.

The blanking punch 68 in the present embodiment is divided into two sections, i.e., a lower section 80 and an upper section 82, which are connected by known connecting members such as connecting pins not shown, such that the lower and upper sections 80, 82 can approach and separate relative to each other by a suitable distance in the vertical direction. Further, between the lower and upper sections 80, 82, a plurality of compression coil springs 84 as a biasing device are provided so as to be accommodated, in the preliminarily compressed state, in respective recesses formed at a plurality of locations in the circumferential direction on the surfaces of the lower and upper sections 80, 82 that are opposed to each other. According to this arrangement, when a metal blank obtained by performing a blanking operation on a plate-like metal material is subjected to a drawing operation by the inner blade 78 of the blanking punch 68 and the outer blade 33 of the blanking die 20 as explained below, the outer peripheral portion of the metal blank is gripped and held by an between the lower section 80 of the blanking punch 68 and the drawing die 22 as shown in FIGS. 3 and 4, based on the biasing force of the compression coil springs 84.

Figure 5:
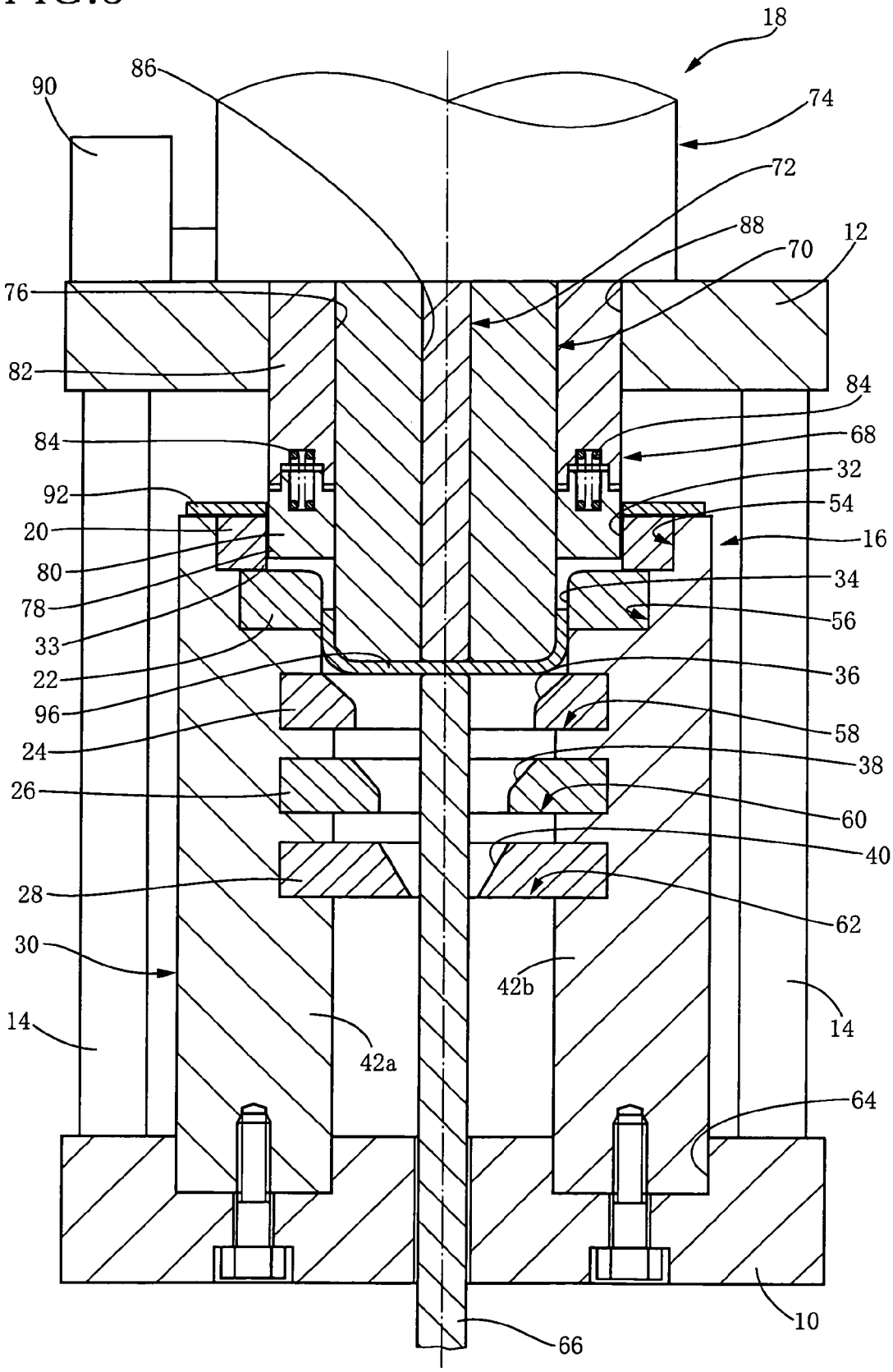
FIG. 5 is a view showing one example of a step following the step shown in FIG. 4, the view showing a state in which a first intermediate product is formed by the drawing operation on the metal blank and the formed first intermediate blank is positioned between a redrawing die and a DI punch.
Figure 6:
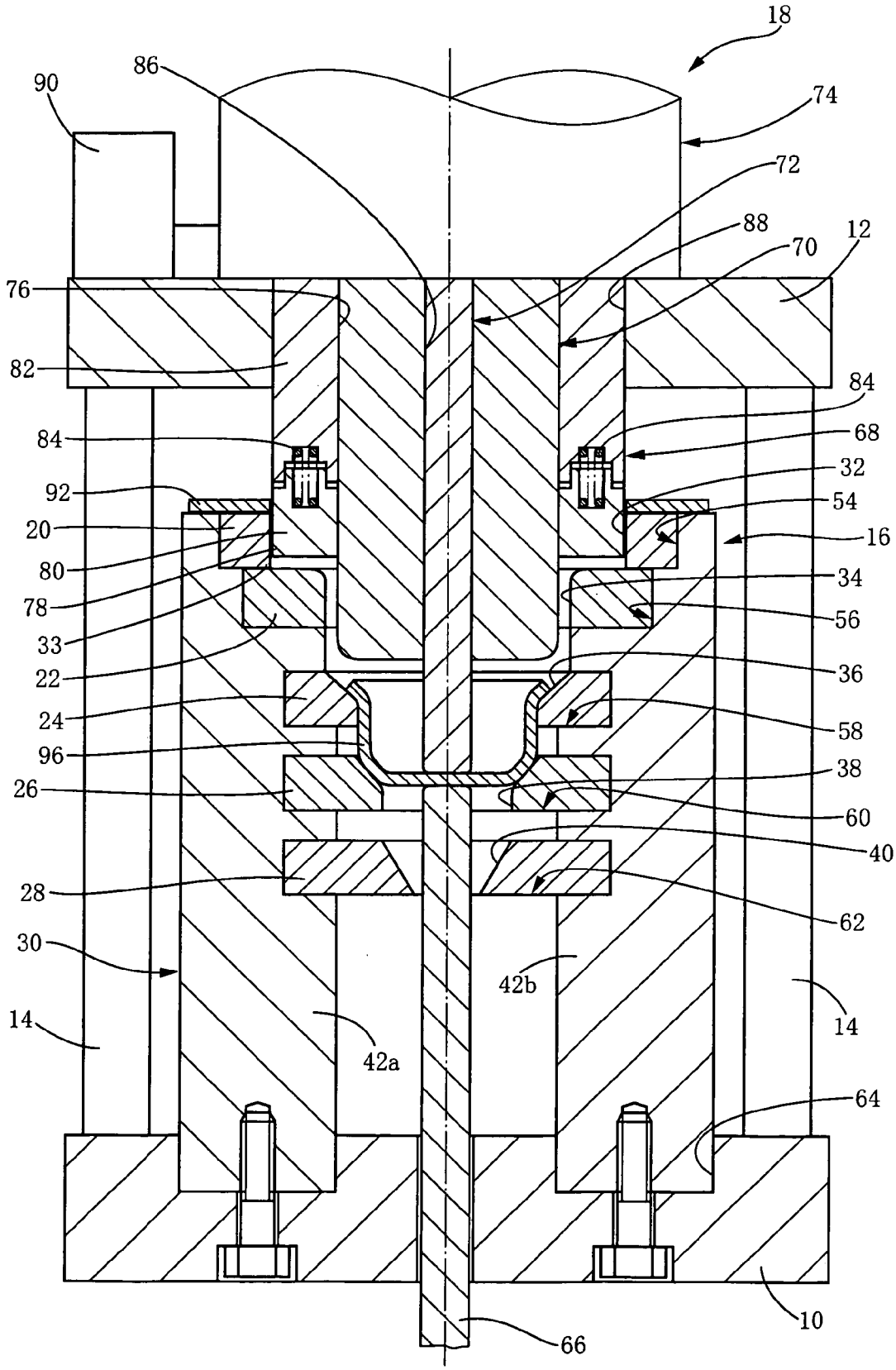
FIG. 6 is a view showing one example of a step following the step shown in FIG. 5, the view showing a state in which the first intermediate product undergoes a redrawing operation.
Figure 7:
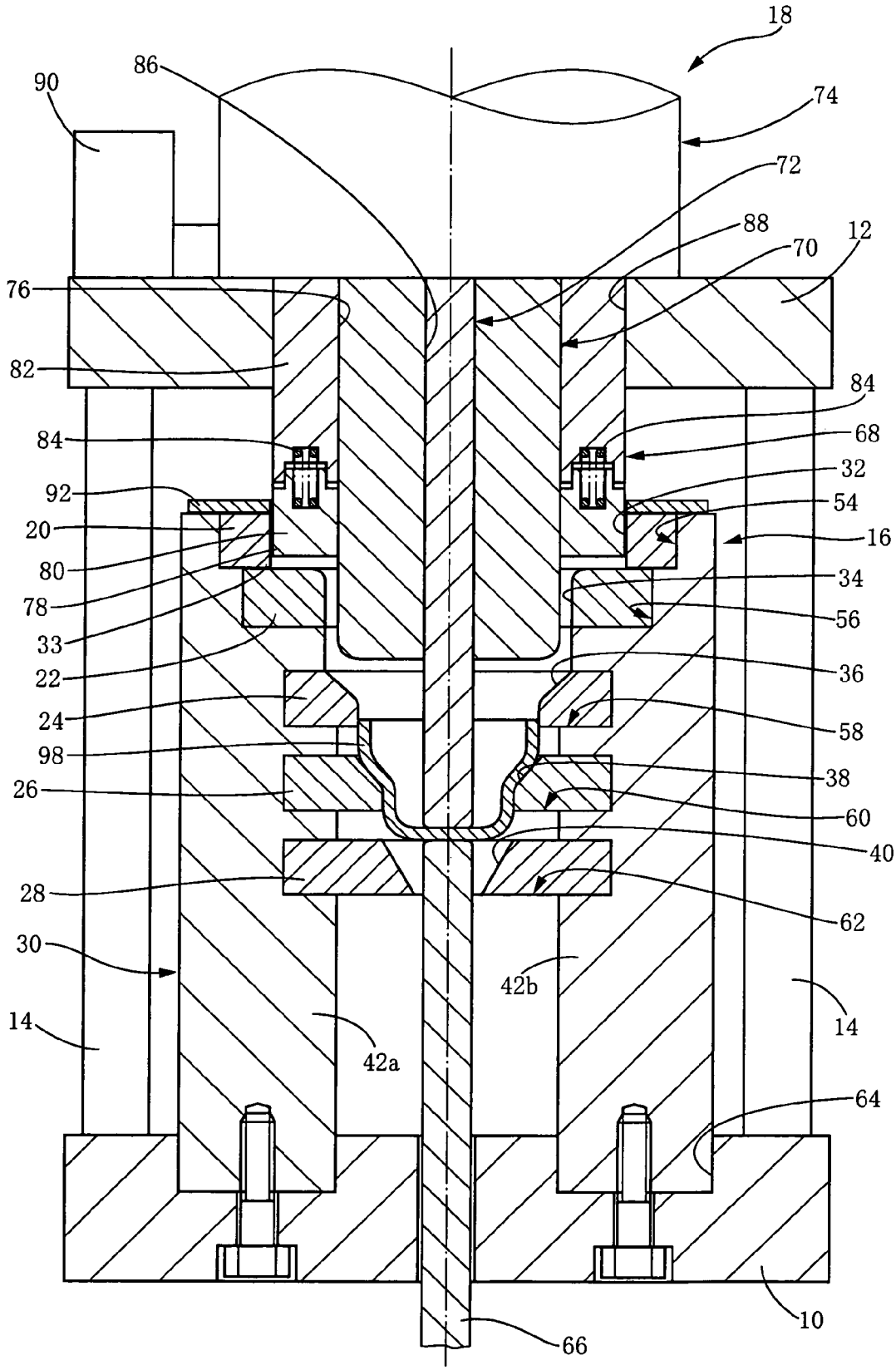
FIG. 7 is a view showing one example of a step following the step shown in FIG. 6, the view showing a state in which a second intermediate product is formed by the redrawing operation on the first intermediate product and the formed second intermediate product is positioned between an ironing die and the DI punch.
Figure 8:
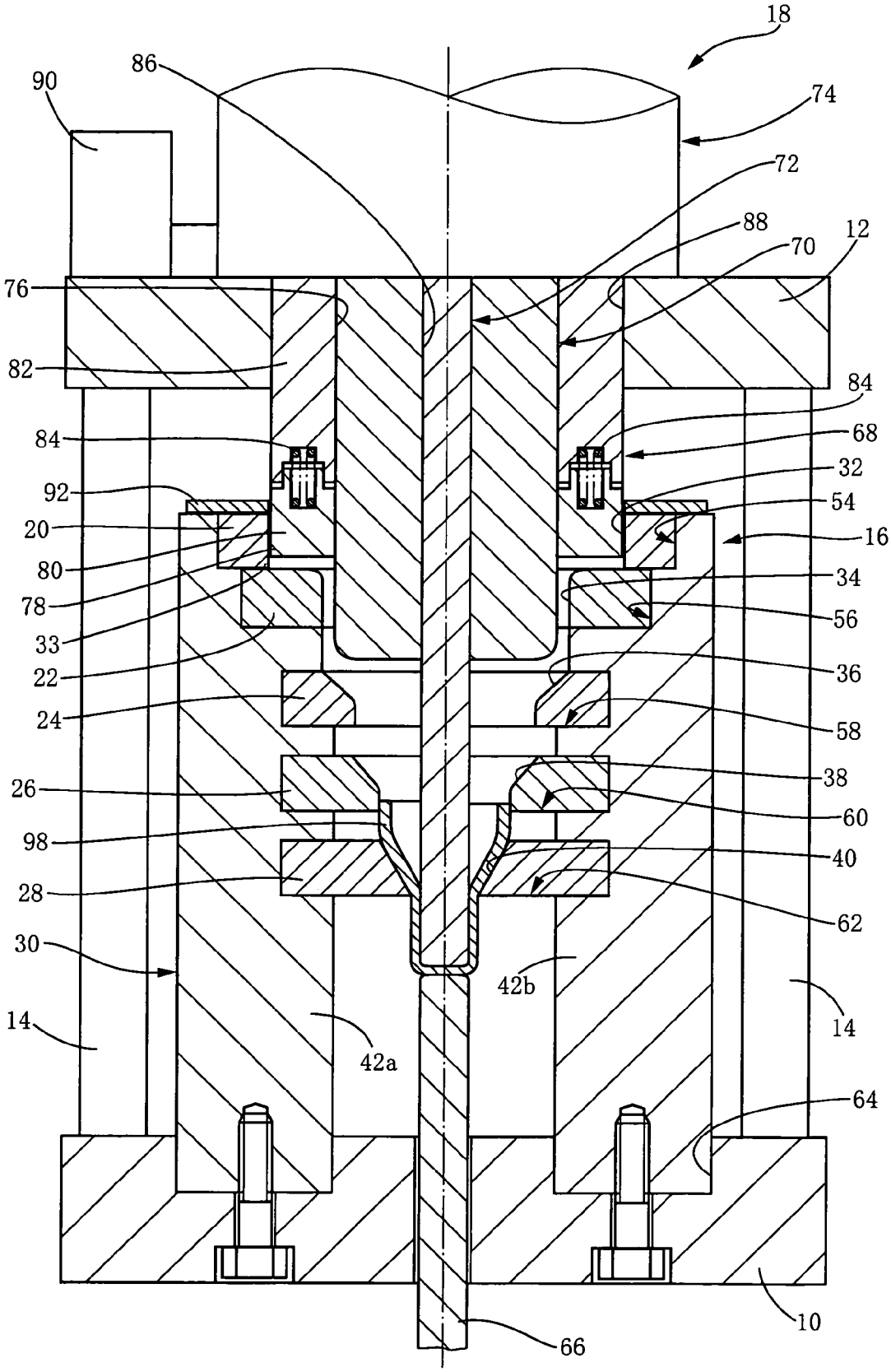
FIG. 8 is a view showing one example of a step following the step shown in FIG. 7, the view showing a state in which the second intermediate product undergoes an ironing operation.

The drawing punch 70 generally has a columnar shape with a large diameter. The drawing punch 70 has an outside diameter that is determined such that drawing punch 70 can be inserted into the die hole 34 of the drawing die 22 as shown in FIGS. 4 and 5. There is formed, at a central portion of the drawing punch 70, a second accommodation hole 86 that extends axially. The DI punch 72 generally has an elongate columnar shape and has an outside diameter that is determined such that the DI punch 72 can be inserted into the die hole 40 of the ironing die 28 through the die holes 36, 38 of the first and second redrawing dies 24, 26 as shown in FIGS. 6-8.

The thus constructed DI punch 72 is accommodated coaxially in the second accommodation hole 86 of the drawing punch 70 so as to be vertically movable. The drawing punch 70 in which the DI punch 72 is accommodated is accommodated, together with the DI punch 72, coaxially in the first accommodation hole 76 of the blanking punch 68 so as to be vertically movable. In other words, the drawing punch 70 is fitted on the DI punch 72 and the blanking punch 68 is fitted on the drawing punch 70, whereby these three punches 68, 70, 72 are disposed so as to be coaxial with each other and assembled together such that these three punches 68, 70, 72 are allowed to be moved relative to each other in the vertical direction.

The thus constructed assembly of the blanking punch 68, the drawing punch 70, and the DI punch 72 is inserted in a through hole 88 to be movable, wherein the through hole 88 is coaxially arranged with the die assembly 16 fixed to the lower base 10 and the through hole 88 has a large diameter. Owing to this, the blanking punch 68, the drawing punch 70, and the DI punch 72 are coaxially positioned above the die assembly 16, which is fixed to the lower base 10, so as to be able to move relative to each other in the axial direction.

In the present embodiment, the lower base 10 into which the three punches 68, 70, 72 are inserted has an upper surface on which are disposed side by side the moving mechanism 74 that cooperates with the three punches 68, 70, 72 to constitute the punch mechanism 18 and a controller 90 for controlling the operation of the moving mechanism 74.

While not shown in FIG. 1, the moving mechanism 74 incorporates three drive sources such as hydraulic cylinders and electric motors. The three drive sources are electrically connected to the controller 90. The blanking punch 68, the drawing punch 70 and the DI punch 72 are connected, at respective upper portions thereof, to the respective three drive sources directly or indirectly via a motion converting mechanism such as a gear mechanism and a crank mechanism for converting a horizontally reciprocating movement of the hydraulic cylinders and a rotary movement of the electric motors into a vertically reciprocating movement. According to this arrangement, upon driving of the drive sources in the moving mechanism 74, the blanking punch 68, the drawing punch 70 and the DI punch 72 are moved in the vertical direction while being controlled independently of each other by the controller 90.

Namely, in a state before the three drive sources in the moving mechanism 74 are driven, the blanking punch 68, the drawing punch 70 and the DI punch 72 are positioned above the die assembly 16 so as to be placed at an upper stroke end of the vertical movement of the three punches 68, 70, 72 with lower end surfaces of the respective three punches 68, 70, 72 flush with each other, as shown in FIG. 1. Subsequently when one of the three drive sources in the moving mechanism 74 that is connected to the blanking punch 68 is driven by a predetermined amount under control of the controller 90, the blanking punch 68 is moved downward, so that the lower end portion of the blanking punch 68 is inserted into the die hole 32 of the blanking die 20 as shown in FIG. 3.

Thereafter, when the two drive sources to which the drawing punch 70 and the DI punch 72 are respectively connected are driven in synchronism with each other by a predetermined amount under control of the controller 90, the drawing punch 70 and the DI punch 72 are advanced from the first accommodation hole 76 of the blanking punch 68 as an integral unit. As a result, the punches 70, 72 are moved downward, whereby the lower end portions of the respective punches 70, 72 are inserted into the die hole 34 of the drawing die 22 as shown in FIGS. 4 and 5.

Subsequently when only the drive source to which the DI punch 72 is connected is driven by a predetermined amount under control of the controller 90, the DI punch 72 is advanced from the second accommodation hole 86 of the drawing punch 70. As a result, the DI punch 72 is moved downward, whereby the lower end portion of the DI punch 72 is inserted sequentially into the die holes 36, 38, 40 of the respective first redrawing die 24, second redrawing die 26 and ironing die 28 and finally penetrate the die hole 40, as shown in FIGS. 6-9.

Namely, owing to the operation of the moving mechanism 74 under control of the controller 90, the inserting movement of the blanking punch 68 into the die hole 32 of the blanking die 20, the insertion of the drawing punch 70 into the die hole 34 of the drawing die 22 as a result of the advancing movement of the drawing punch 70 from the first accommodation hole 76, and the insertion of the DI punch 72 into the die holes 36, 38, 40 of the respective first redrawing die 24, second redrawing die 26 and ironing die 28 as a result of the advancing movement of the DI punch 72 from the second accommodation hole 86 are performed automatically in sequence. In this instance, the downward movements of the punches 68, 70, 72 are controlled by the controller 90 such that the DI punch 72 and the drawing punch 70 are moved together with the respective lower end surfaces of the DI punch 72 and the drawing die 22 flush with each other, until the DI punch 72 is advanced from the second accommodation hole 86. Thus, it is apparent that the controller 90 constitutes a first controller and a second controller.

A battery case is produced in the following manner, for instance, using the battery case producing apparatus constructed as described above.

Figure 2:
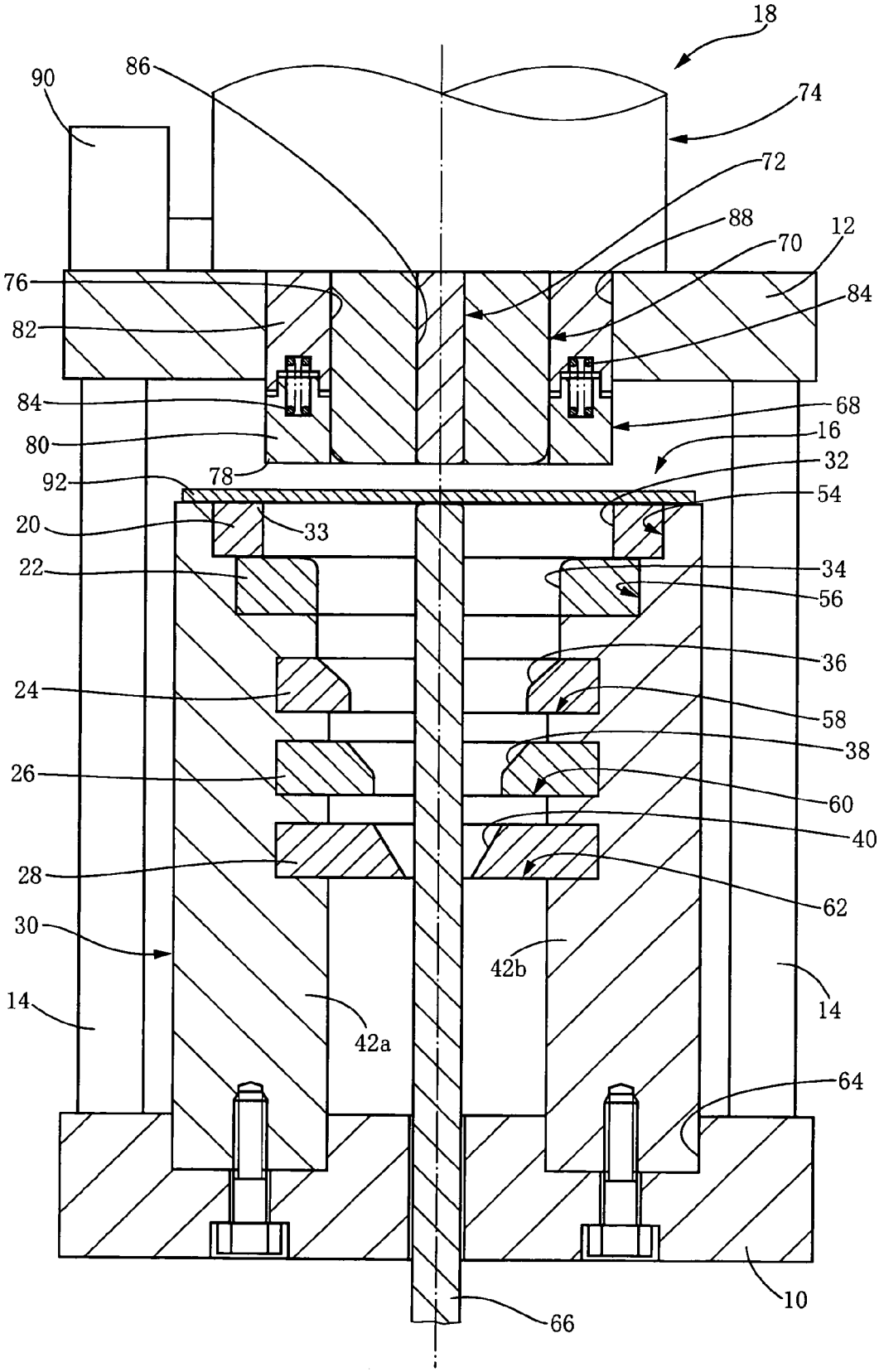
FIG. 2 is a view for explaining one example of a step of producing a battery case according to the present method using the apparatus shown in FIG. 1, the view showing a state in which a plate-like metal material is set in the apparatus.

Initially, a plate-like metal material 92 in the form of a thin flat plate is placed on the upper surface of the blanking die 20 while being in contact with a leading end face of the knockout 66, so as to cover the entirety of the die hole 32 of the blanking die 20, as shown in FIG. 2. As the plate-like metal material 92, there may be suitably used an aluminum plate, an iron plate, a steel plate or the like. The plate-like metal material 92 is constituted by a material having a size sufficient for forming a single battery case or a strip-like material having a size large enough for forming a plurality of battery cases.

Next, as shown in FIG. 3, only the blanking punch 68 is moved downward based on the operation of the moving mechanism 74 controlled by the controller 90 and the lower end portion of the blanking punch 68 is inserted into the die hole 32 of the blanking die 20, whereby the blanking operation is performed on the plate-like metal material 92 by the blanking punch 68 and the blanking die 20. As a result, the plate-like metal material 92 is cut by the inner blade 78 of the blanking punch 68 and the outer blade 33 of the blanking die 20 so as to be formed into a metal blank 94 having a circular shape that corresponds to the die hole 32 of the blanking die 20.

As the blanking punch 68 is moved downward, the thus formed metal blank 94 is moved downward, i.e., toward the drawing die 22, together with the knockout 66, so that the meal blank 94 is positioned between the drawing die 22 and the lower section 80 of the blanking punch 68. In this state, the metal blank 94 is gripped and held, at its outer peripheral portion, by and between the lower end surface of the lower section 80 of the blanking punch 68 and the upper surface of the drawing die 22, based on the biasing force of the compression coil springs 84.

Subsequently, as shown in FIGS. 4 and 5, the drawing punch 70 and the DI punch 72 which is disposed in the second accommodation hole 86 of the drawing punch 70 are advanced (i.e., moved downward) from the first accommodation hole 76 of the blanking punch 68 as an integral unit based on the operation of the moving mechanism 74 controlled by the controller 90, and the lower end portions of the punches 70, 72 are inserted into the die hole 34 of the drawing die 22, whereby the drawing operation is performed on the metal blank 94 by the drawing punch 70 and the drawing die 22. As a result, there is formed a first intermediate product 96 which has a shallow cylindrical shape having a closed end and an outer circumferential surface that is made as a cylindrical surface corresponding to the inner circumferential surface of the die hole 34 of the drawing die 22.

In this instance, because the outer peripheral portion of the metal blank 94 is gripped and held, based on the biasing force of the compression coil springs 84, between the lower end surface of the lower section 80 of the blanking punch 68 and the upper surface of the drawing die 22, the gripping or holding force with respect to the outer peripheral portion of the metal blank 94 acts on the metal blank 94 as a blank holder pressure or force during the drawing operation thereon. In addition, the drawing punch 70 and the DI punch 72 are moved downward as an integral unit, so that their lower end faces are made flush with each other. Accordingly, the drawing operation on the metal blank 94 can be performed with higher stability and more smoothly, thereby advantageously forming the first intermediate product 96 having the outer circumferential surface that well corresponds to the inner circumferential surface of the die hole 34 of the drawing die 22, without suffering from any defects such as wrinkles.

As the drawing punch 70 and the DI punch 72 are integrally moved downward, the first intermediate product 96 is moved downward, i.e., toward the first redrawing die 24, together with the knockout 66, so that the first intermediate product 96 is positioned between the first redrawing die 24 and the lower end surfaces of the drawing punch 70 and the DI punch 72 while being supported by the knockout 66.

Subsequently, as shown in FIGS. 6 and 7, the DI punch 72 is advanced (i.e., moved downward) from the second accommodation hole 86 of the drawing punch 70 based on the operation of the moving mechanism 74 controlled by the controller 90, so that the lower end portion of the DI punch 72 is inserted successively into the die hole 36 of the first redrawing die 24 and the die hole 38 of the second redrawing die 26 that is smaller than the die hole 36. Thus, the redrawing operation on the first intermediate product 96 is performed successively two times by the DI punch 72 and the first redrawing die 24 and by the DI punch 72 and the second redrawing die 26. As a consequence, there is formed a second intermediate product 98 which has a stepped cylindrical shape having a closed end and a larger depth than the first intermediate product 96, as shown in FIG. 7. In the second intermediate product 98, the outer circumferential surface at its upper end portion is made as a cylindrical surface that corresponds to the inner circumferential surface of the die hole 36 of the first redrawing die 24 while the outer circumferential surface at its lower end portion is made as a cylindrical surface that corresponds to the inner circumferential surface of the die hole 38 of the second redrawing die 26.

As the DI punch 72 is further moved downward, the second intermediate product 98 is moved downward, i.e., toward the ironing die 28, together with the knockout 66, so that the second intermediate product 98 is positioned between the ironing die 28 and the lower end surface of the DI punch 72 while being supported by the knockout 66.

Figure 9:
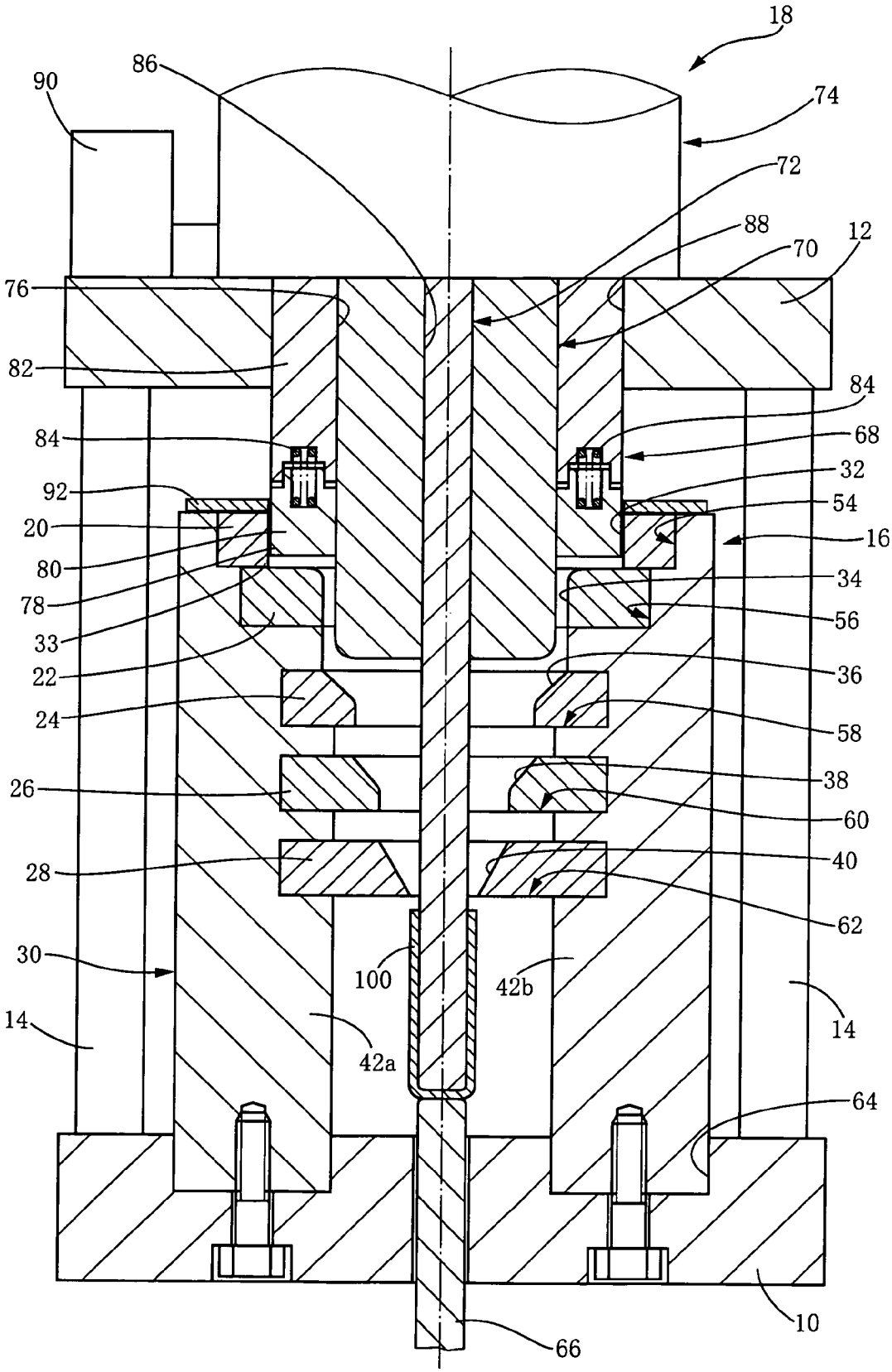
FIG. 9 is a view showing one example of a step following the step shown in FIG. 8, the view showing a state in which a battery case is formed by the ironing operation performed on the second intermediate product.

Thereafter, as shown in FIGS. 8 and 9, the DI punch 72 is further advanced (i.e., moved downward) from the second accommodation hole 86 of the drawing punch 70 based on the operation of the moving mechanism 74 controlled by the controller 90, and the lower end portion of the DI punch 72 is inserted into the die hole 40 of the ironing die 28, whereby the ironing operation is performed on the second intermediate product 98 by the DI punch 72 and the ironing die 28. Consequently, there is formed a battery case 100 having a cylindrical shape which has a closed end and a smaller thickness and a larger depth than the second intermediate product 98 and whose outer circumferential surface is made as a cylindrical surface that corresponds to the inner circumferential surface of the die hole 40 of the ironing die 28.

Subsequently, the blanking punch 68, the drawing punch 70 and the DI punch 72 are raised so as to be placed at the upper stroke end shown in FIGS. 1 and 2 by the operation of the moving mechanism 74 under control of the controller 90 while, on the other hand, the formed battery case 100 is removed from the DI punch 72, whereby the intended battery case 100 is obtained.

In the present embodiment explained above, the operation of the moving mechanism 74 is controlled by the controller 90 to sequentially carry out: the first process step in which the plate-like metal material 92 is formed into the metal blank 94 by the blanking operation performed on the plate-like metal material 92 by the blanking punch 68 and the blanking die 20; the second process step in which the metal blank 94 is formed into the first intermediate product 96 by the drawing operation performed on the metal blank 94 by the drawing punch 70 and the drawing die 22; and the third process step in which the first intermediate product 96 is formed into the battery case 100 via the second intermediate product by performing the DI processing in which are sequentially carried out the two successive (two-stage) redrawing operations by the DI punch and the first and second redrawing dies 24, 26 and the ironing operation by the DI punch 72 and the ironing die 28. The first through the third process steps are carried out by the sequential working operation of moving the blanking punch 68, the drawing punch 70 and the DI punch 72 downwards automatically and sequentially whereby the intended battery case 100 can be easily and efficiently produced from the plate-like metal material 92.

In the present embodiment, the apparatus for producing the intended battery case 100 is constituted by a single apparatus in which the die assembly 16, the punch mechanism 18 and the controller 90 are mounted on the integrally assembled lower base 10 and the upper base 12. In contrast, the conventional system for producing the battery case 100 uses two apparatus, i.e., the apparatus which includes: a blanking die and a drawing die; a blanking punch and a drawing punch; and a moving mechanism for moving the punches so as to be inserted into corresponding die holes of the respective dies and which forms the first intermediate product 96 from the plate-like metal material 92 via the metal blank 94, and the apparatus which includes: redrawing dies and ironing dies; a DI punch; and a moving mechanism for moving the DI punch so as to be inserted into die holes of the respective dies and which forms the battery case 100 from the first intermediate product 96 via the second intermediate product 98. In the present arrangement, therefore, the space for disposing only the single apparatus for producing the battery case 100 is required, thereby effectively reducing the installation space for the battery case producing apparatus and accordingly the work area required for producing the battery case 100.

Further, in the present embodiment, while the apparatus for producing the battery case 100 includes the punches 68-72 and the dies 20-28 the numbers of which are the same as those of the punches and dies in the conventional system for producing the battery case 100 using the two apparatus described above, the punches 68-72 are arranged to be moved so as to be insertable into the die holes 32-40 of the respective dies 20-28 by the single moving mechanism 74. Accordingly, as compared with the conventional system in which the two moving mechanisms are used, the present apparatus using only the single moving mechanism advantageously assures reduced cost of the apparatus and accordingly reduced cost of manufacture of the battery case 100.

In the course of formation of the battery case 100, the metal blank 94, the first intermediate product 96 and the second intermediate product 98 are automatically moved, by the advancing or inserting movements of the punches 68-72 into the corresponding die holes 32-40 of the dies 20-28, to the respective locations where the drawing operation on the metal blank 94, the redrawing operation on the first intermediate product 96 and the ironing operation on the second intermediate product 98 are performed, without using any special transfer device. Accordingly, the plurality of operations indicated above can be performed consecutively and smoothly.

Therefore, unlike the aforementioned conventional system for producing the battery case 100 using the two apparatus and the transfer device for transferring the intermediate product between the two apparatus, the present arrangement does not need such a transfer device, thereby attaining elimination of the installation space for the transfer device and the cost reduction.

According to the present embodiment, the intended battery case 100 can be automatically produced through the DI processing at a reduced cost under industrially advantageous conditions. As a result, the battery case 100 which is lightweight and has excellent pressure withstanding strength can be obtained with high productivity and at reduced cost.

When the drawing operation is performed on the metal blank 94, the blank folding pressure acts on the outer peripheral portion of the metal blank 94 between the lower end surface of the lower portion 80 of the blanking punch 68 and the upper surface of the drawing die 22 on the basis of the biasing force of the compression coil springs 84 while, at the same time, the lower surfaces of the drawing punch 70 and the DI punch 72 are made flush with each other. Therefore, the metal blank 94 is formed, by the drawing operation, into the first intermediate product 96 which is free from defects such as wrinkles or folds and whose outer circumferential surface well corresponds to the inner circumferential surface of the die hole 34 of the drawing die 22. Accordingly, the redrawing operations and the ironing operation to be subsequently performed on the first intermediate product 96 can be smoothly implemented with high stability, resulting in stable production of the intended battery case 100 with the desired shape.

While the presently preferred embodiment of the invention has been described in detail, for illustrative purpose only, it is to be understood that the present invention is not limited to the details of the illustrated embodiment, but may be otherwise embodied.

In the illustrated embodiment, the controller 90 controls the moving mechanism 74 such that the blanking punch 68 as the first punch, the drawing punch 70 as the second punch and the DI punch 72 as the third punch are sequentially and automatically moved downward so as to be inserted into the corresponding die holes 32-40 of the dies 20-28. There may be provided for a switch mechanism or the like for moving the punches 68-72 downward, for instance, and the punches 68-72 may be arranged to be sequentially moved downward by manipulation of the switch mechanism by an operator.

The structure by which the punches 68-72 and the die assembly 16 are disposed or installed is not limited to that illustrated above.

The dies 20-28 may be otherwise mounted on the die holder 30, provided that the dies are immovably and coaxially arranged in the order of the sizes of the respective die holes 32-40.

Further, the numbers of the blanking die, the drawing die, the redrawing die and the ironing die are not particularly limited, provided that the die assembly 16 includes at least one blanking die which cooperates with the blanking punch 68 to perform the blanking operation on the plate-like metal material 92, at least one drawing die which cooperates with the drawing punch 70 to perform the drawing operation on the metal blank 94, at least one redrawing die which cooperates with the DI punch 72 to perform the redrawing operation on the first intermediate product 96, and at least one ironing die which cooperates with the DI punch 72 to perform the ironing operation on the second intermediate product 98.

The configuration of each of the punches 68-72 and the configuration of each of the die holes 32-40 of the respective dies 20-28 are not limited to those in the illustrated embodiment, but may be suitably changed depending upon the shape of the battery case 100 to be obtained. Where a battery case having an elliptical tubular shape with a closed end or a battery case having a prismatic tubular shape with a closed end is produced, for instance, each punch and each die hole are configured to have an elliptical shape or a rectangular shape.

While the apparatus and method for producing the battery case for the secondary battery has been described above as the preferred embodiment of the present invention, the principle of the invention is equally applicable to an apparatus and method for producing a battery case for a primary battery such as a dry battery.

It is to be understood that the present invention may be embodied with various other changes and modifications, which may occur to those skilled in the art, without departing from the scope of the invention defined in the appended claims.

What is claimed is:

1. An apparatus for producing a battery case which has a tubular shape with a closed end and which houses an electricity-generating element, the apparatus comprising:

a die assembly including: a blanking die having a die hole with a predetermined size; a drawing die having a die hole whose size is smaller than that of the die hole of the blanking die; a redrawing die having a die hole whose size is smaller than that of the die hole of the drawing die; and an ironing die having a die hole whose size is smaller than that of the die hole of the redrawing die, the blanking die, the drawing die, the redrawing die and the ironing die being coaxially arranged in series in the order of the sizes of the die holes of the respective dies, such that the respective dies are inhibited from moving;

a first punch which is disposed coaxially with respect to the die assembly so as to be located on one side of the blanking die remote from the drawing die, such that the first punch can be inserted into the die hole of the blanking die and which has a first accommodation hole that extends so as to be coaxial with the die hole of the blanking die;

a second punch which is accommodated coaxially in the first accommodation hole of the first punch such that the second punch can be advanced toward the blanking die, which is disposed so as to be insertable into the die hole of the drawing die as a result of the advancing movement thereof from the first accommodation hole, and which has a second accommodation hole that extends so as to be coaxial with the first accommodation hole;

a third punch which is accommodated coaxially in the second accommodation hole of the second punch such that the third punch can be advanced toward the blanking die and which is disposed so as to be insertable sequentially into the die hole of the redrawing die and the die hole of the ironing die as a result of the advancing movement thereof from the second accommodation hole; and a moving mechanism which permits the inserting movement of the first punch into the die hole of the blanking die, the advancing movement of the second punch from the first accommodation hole and the advancing movement of the third punch from the second accommodation hole to be performed independently of each other, wherein, with a metal plate positioned between the blanking die and the first punch, the inserting movement of the first punch, the advancing movement of the second punch and the advancing movement of the third punch are carried out sequentially in order by the moving mechanism to sequentially perform: a blanking operation by the first punch and the blanking die on the metal plate so as to form a metal blank having a configuration that corresponds to the die hole of the blanking die; a drawing operation by the second punch and the drawing die on the metal blank so as to form a tubular intermediate product having a closed end and a predetermined depth; and a redrawing operation by the third punch and the redrawing die and an ironing operation by the third punch and the ironing die on the tubular intermediate product so as to form a tubular battery case as an end product having a closed end and a smaller wall thickness and a larger depth than the tubular intermediate product.

2. The apparatus according to claim 1, further comprising a first controller which controls the moving mechanism such that the inserting movement of the first punch, the advancing movement of the second punch and the advancing movement of the third punch are performed automatically and sequentially in order.

3. The apparatus according to claim 1, further comprising a second controller which controls the movements of the first punch, the second punch and the third punch such that the third punch is moved together with the second punch so that a leading end face of the third punch as seen in a direction of the advancing movement thereof is flush with a leading end face of the second punch as seen in a direction of the advancing movement thereof, until the tubular intermediate product is formed by the drawing operation performed by the second punch and the drawing die as a result of the advancing movement of the second punch from the first accommodation hole.

4. The apparatus according to claim 1, wherein the first punch is divided into a front section and a rear section as seen in a direction of the inserting movement thereof into the die hole of the blanking die, the front section and the rear section being assembled together so as to approach and separate relative to each other, and wherein the first punch is provided with a biasing device disposed between the front section and the rear section for applying biasing force to the front section and the rear section in a direction in which the front section and the rear section are separated away from each other, the metal blank formed as a result of the inserting movement of the first punch into the die hole of the blanking die being gripped and held by and between the first punch and the drawing die based on the biasing force of the biasing device.

5. An apparatus according to claim 1, wherein said first, second and third punches are positioned above the die assembly, so that the metal plate is placed on the upper surface of the blanking die of the die assembly.

6. An apparatus according to claim 1, wherein said die hole of the redrawing die is defined by an inner circumferential surface thereof which has an upper tapered portion whose diameter gradually decreases in a downward direction.

7. An apparatus according to claim 1, wherein the die hole of the ironing die is defined by an inner circumferential surface thereof which is tapered in the downward direction with a diameter gradually decreasing in the downward direction.

8. A method of producing a battery case which has a tubular shape with a closed end and which houses an electricity-generating element, comprising:

a preparing step of preparing: (a) a die assembly including a blanking die having a die hole with a predetermined size, a drawing die having a die hole whose size is smaller than that of the die hole of the blanking die, a redrawing die having a die hole whose size is smaller than that of the die hole of the drawing die and an ironing die having a die hole whose size is smaller than that of the die hole of the redrawing die, the blanking die, the drawing die, the redrawing die and the ironing die being coaxially arranged in series in the order of the sizes of the die holes of the respective dies, such that the respective dies are inhibited from moving; (b) a first punch which is disposed coaxially with respect to the die assembly so as to be located on one side of the blanking die remote from the drawing die, such that the first punch can be inserted into the die hole of the blanking die and which has a first accommodation hole that extends so as to be coaxial with the die hole of the blanking die; (c) a second punch which is accommodated coaxially in the first accommodation hole of the first punch such that the second punch can be advanced toward the blanking die, which is disposed so as to be insertable into the die hole of the drawing die as a result of the advancing movement thereof from the first accommodation hole, and which has a second accommodation hole that extends so as to be coaxial with the first accommodation hole; and (d) a third punch which is accommodated coaxially in the second accommodation hole of the second punch such that the third punch can be advanced toward the blanking die and which is disposed so as to be insertable sequentially into the die hole of the redrawing die and the die hole of the ironing die as a result of the advancing movement thereof from the second accommodation hole;

a first process step in which a blanking operation by the first punch and the blanking die is performed on a metal plate by inserting the first punch into the die hole of the blanking die with the metal plate positioned between the blanking die and the first punch, thereby forming a metal blank having a configuration that corresponds to the die hole of the blanking die and in which the metal blank is moved toward the drawing die so as to be positioned between the second punch and the drawing die;

a second process step in which a drawing operation by the second punch and the drawing die is performed on the metal blank obtained in the first process step and positioned between the second punch and the drawing die, by advancing the second punch from the first accommodation hole so as to be inserted into the die hole of the drawing die, thereby forming a tubular intermediate product having a closed end and a predetermined depth and in which the tubular intermediate product is moved toward the redrawing die so as to be positioned between the third punch and the redrawing die; and a third process step in which a redrawing operation by the third punch and the redrawing die and an ironing operation by the third punch and the ironing die are sequentially performed on the tubular intermediate product obtained in the second process step and positioned between the third punch and the redrawing die, by advancing the third punch from the second accommodation hole so as to be inserted sequentially into the die hole of the redrawing die and the die hole of the ironing die, thereby forming a tubular battery case as an end product having a closed end and a smaller wall thickness and a larger depth than the tubular intermediate product.

* * * * *